US008302579B2

(12) United States Patent
Sugishita

(10) Patent No.: US 8,302,579 B2
(45) Date of Patent: Nov. 6, 2012

(54) PORTABLE WORK MACHINE

(75) Inventor: Yuu Sugishita, Kawagoe (JP)

(73) Assignee: Husqvarna Zenoah Co., Ltd., Kawagoe-shi (JP)

( * ) Notice: Subject to any disclaimer, the term of this patent is extended or adjusted under 35 U.S.C. 154(b) by 908 days.

(21) Appl. No.: 12/227,415

(22) PCT Filed: May 17, 2007

(86) PCT No.: PCT/JP2007/060120

§ 371 (c)(1), (2), (4) Date: Nov. 17, 2008

(87) PCT Pub. No.: WO2007/132914

PCT Pub. Date: Nov. 22, 2007

(65) Prior Publication Data

US 2009/0235538 A1 Sep. 24, 2009

(30) Foreign Application Priority Data

May 17, 2006 (JP) ..... 2006-137627

(51) Int. Cl.
*F02B 77/04* (2006.01)
*F02M 35/02* (2006.01)

(52) U.S. Cl. ..... 123/198 E; 123/41.7

(58) Field of Classification Search ..... 123/198 E, 123/41.7; 30/381
See application file for complete search history.

(56) References Cited

U.S. PATENT DOCUMENTS 4,266,515 A * 5/1981 Bross ..... 123/198 E
4,592,445 A * 6/1986 Sawada ..... 181/229
4,876,797 A 10/1989 Zapata
5,018,492 A * 5/1991 Wolf et al. ..... 123/198 E
5,233,945 A * 8/1993 Wolf et al. ..... 123/41.7
5,367,988 A * 11/1994 Collins ..... 123/41.65
5,595,153 A * 1/1997 Hoppner et al. ..... 123/198 E
6,378,467 B1 * 4/2002 Kobayashi et al. ..... 123/41.56
6,438,852 B2 * 8/2002 Taomo et al. ..... 30/383
6,478,346 B1 11/2002 Veser et al.
6,761,136 B2 * 7/2004 Ohsawa ..... 123/41.56
6,786,192 B2 * 9/2004 Uhl ..... 123/198 E
6,807,954 B2 * 10/2004 Nara et al. ..... 123/556
7,007,660 B2 * 3/2006 Taomo et al. ..... 123/198 E
2001/0010122 A1 * 8/2001 Taomo et al. ..... 30/383

(Continued)

FOREIGN PATENT DOCUMENTS

JP 57-123955 A 8/1982

(Continued)

OTHER PUBLICATIONS

Extended European Search Report dated Jun. 16, 2010 (in English) issued in counterpart European Application No. 07743555.0.

(Continued)

*Primary Examiner* — Noah Kamen
*Assistant Examiner* — Grant Moubry
(74) *Attorney, Agent, or Firm* — Holtz, Holtz, Goodman & Chick, PC

(57) ABSTRACT

A chain saw as a portable work machine includes: a body in which an engine is accommodated; a carburetor accommodated in a top handle for generating air-fuel mixture to be supplied to the engine; an air cleaner provided on a lateral side of the body; and an intake communication passage that intercommunicates between the air cleaner and the carburetor.

3 Claims, 5 Drawing Sheets

U.S. PATENT DOCUMENTS

| | | | | |
|---|---|---|---|---|
| 2003/0172898 | A1 | 9/2003 | Uhl | |
| 2003/0183208 | A1 | 10/2003 | Nara et al. | |
| 2003/0221640 | A1 * | 12/2003 | Ohsawa | 123/41.56 |
| 2005/0050867 | A1 | 3/2005 | Taomo et al. | |

FOREIGN PATENT DOCUMENTS

| | | | |
|---|---|---|---|
| JP | 57-123955 | U | 8/1982 |
| JP | 5-195891 | A | 8/1993 |
| JP | 7-026979 | A | 1/1995 |
| JP | 3030620 | U | 11/1996 |
| JP | 11-132118 | A | 5/1999 |
| JP | 2000-345841 | A | 12/2000 |
| JP | 2005-083241 | A | 3/2005 |

OTHER PUBLICATIONS

Japanese Office Action dated Feb. 8, 2011 and English translation thereof in counterpart Japanese Application No. 2006-137627.

International Preliminary Report on Patentability and Written Opinion of the International Searching Authority, dated Dec. 10, 2008, issued in connection with International Application Serial No. PCT/JP2007/060120 (4 pages).

Japanese Office Action dated Jul. 26, 2011 (and English translation thereof) in counterpart Japanese Application No. 2006-137627.

* cited by examiner

PORTABLE WORK MACHINE

This application is a U.S. National Phase Application under 35 USC 371 of International Application PCT/JP2007/060120 filed May 17, 2007.

TECHNICAL FIELD

The present invention relates to a portable work machine such as a chain saw and a hand saw, and more particularly to miniaturization of a portable work machine.

BACKGROUND ART

A chain saw has been conventionally known as a portable work machine driven by an engine. Such a chain saw sometimes includes a top handle provided above a body that houses the engine (for example, see Patent Document 1). While the top handle is commonly used for a relatively small chain saw, a carburetor and an air cleaner are sometimes accommodated in a rear portion of the top handle to further downsize the chain saw.

Patent Document 1: JP-A-5-195891

DISCLOSURE OF THE INVENTION

Problems to be Solved by the Invention

However, when the carburetor and the air cleaner are accommodated in the top handle, a part of the top handle is enlarged even though the body is greatly downsized as a whole. Therefore, the chain saw does not appear to be downsized in appearance. Especially, the chain saw appears to be larger than it actually is when a rear portion of the top handle is enlarged. Thus, there has been a demand for improvement in this respect.

An object of the invention is to provide a portable work machine capable of not only actually being downsized by suppressing the size of a top handle, but also being visually downsized in appearance.

Means for Solving the Problems

A portable work machine according to an aspect of the invention includes a body in which an engine is accommodated, a carburetor accommodated in the top handle, the carburetor generating air-fuel mixture to be supplied to the engine, an air cleaner provided on a lateral side of the body, and an intake communication passage that intercommunicates between the air cleaner and an intake passage of the carburetor.

Although a sprocket attached to one end of a crankshaft of the engine, a cooling fan attached to the other end of the crankshaft, a recoil starter in the outside of the cooling fan and the like are disposed on the lateral side of the body, some space on the lateral side of the body has been conventionally a dead space. Therefore, the air cleaner is disposed in this space on the lateral side of the body according to the aspect of the invention, so that the air cleaner can be disposed on the lateral side of the body without increasing the size of the body. As a result, a carburetor chamber in a top handle is downsized so that the top handle is substantially downsized. Thus, the portable work machine appears to be downsized as a whole.

A cover may be provided on the lateral side of the body, an open-close lid may be provided in an opening portion of the cover, and the air cleaner may be covered with the open-close lid.

In this arrangement, the air cleaner is attached and detached by opening and closing the open-close lid for maintenance, which allows a proper maintenance without taking off the whole cover.

The open-close lid may be rotatably and pivotally supported by the cover through a hinge provided on a lower side of the open-close lid, and the air cleaner may be vertically inserted into and removed from the body through an upper opening portion formed by opening the open-close lid.

In this arrangement, the open-close lid is rotated to be opened for attaching and detaching the air cleaner in a cartridge manner, which allows a further efficient maintenance.

BEST MODE FOR CARRYING OUT THE INVENTION

An exemplary embodiment of the invention will be described below with reference to the drawings.

Figure 1:
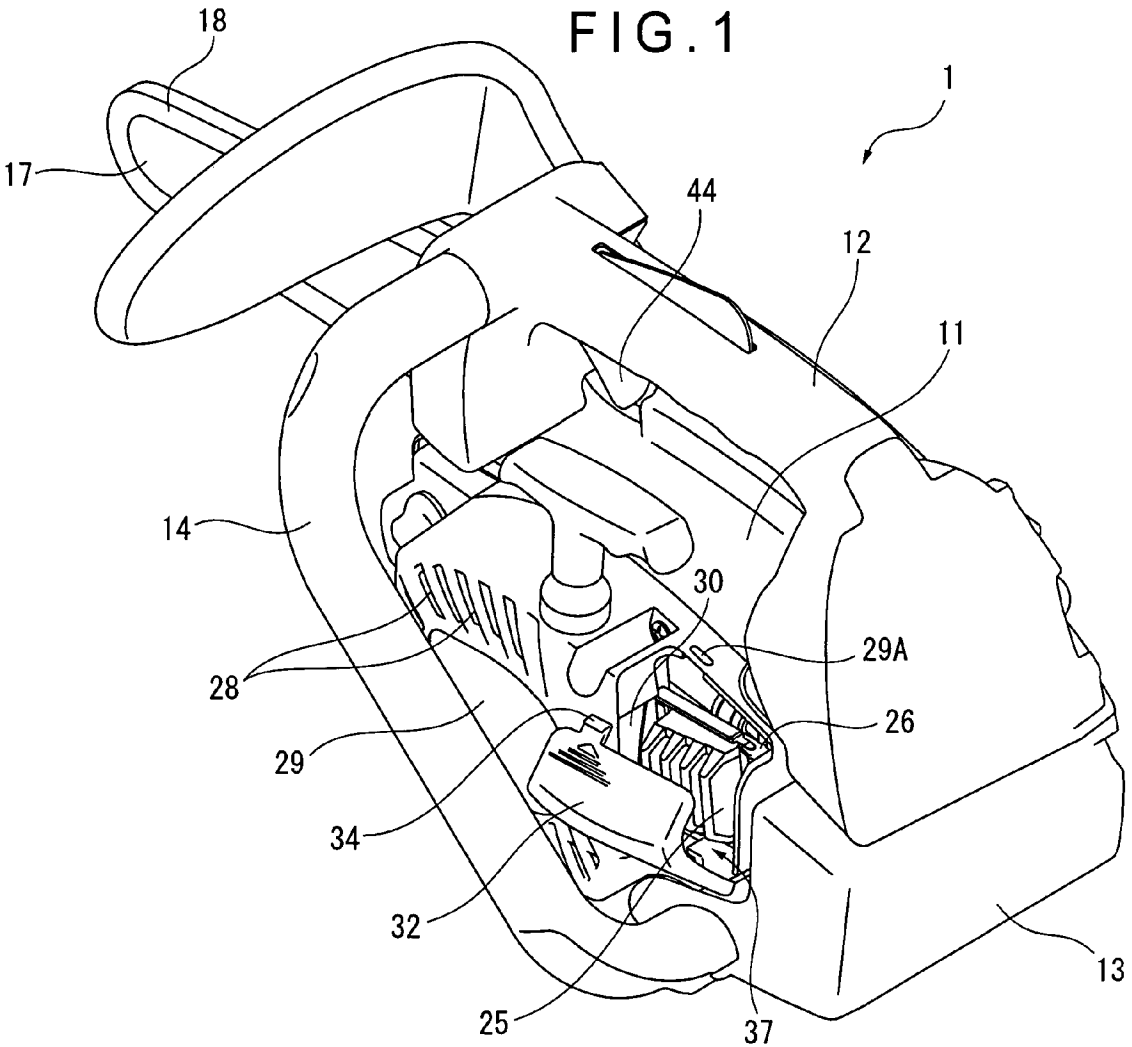
FIG. 1 is a perspective view schematically illustrating an entire chain saw according to an exemplary embodiment of the invention.
Figure 2:
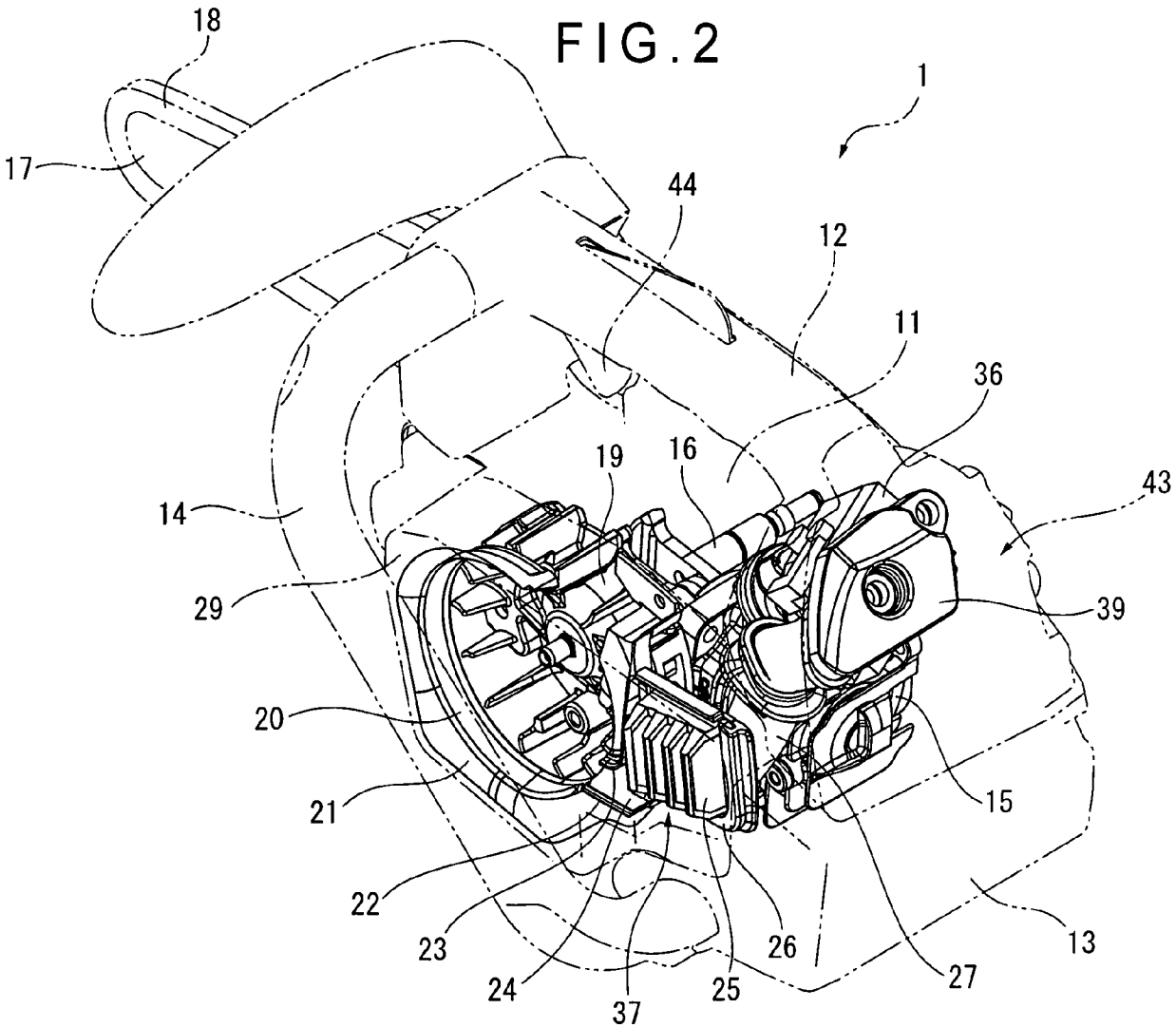
FIG. 2 is a perspective view illustrating a primary portion of a portable work machine.
Figure 3:
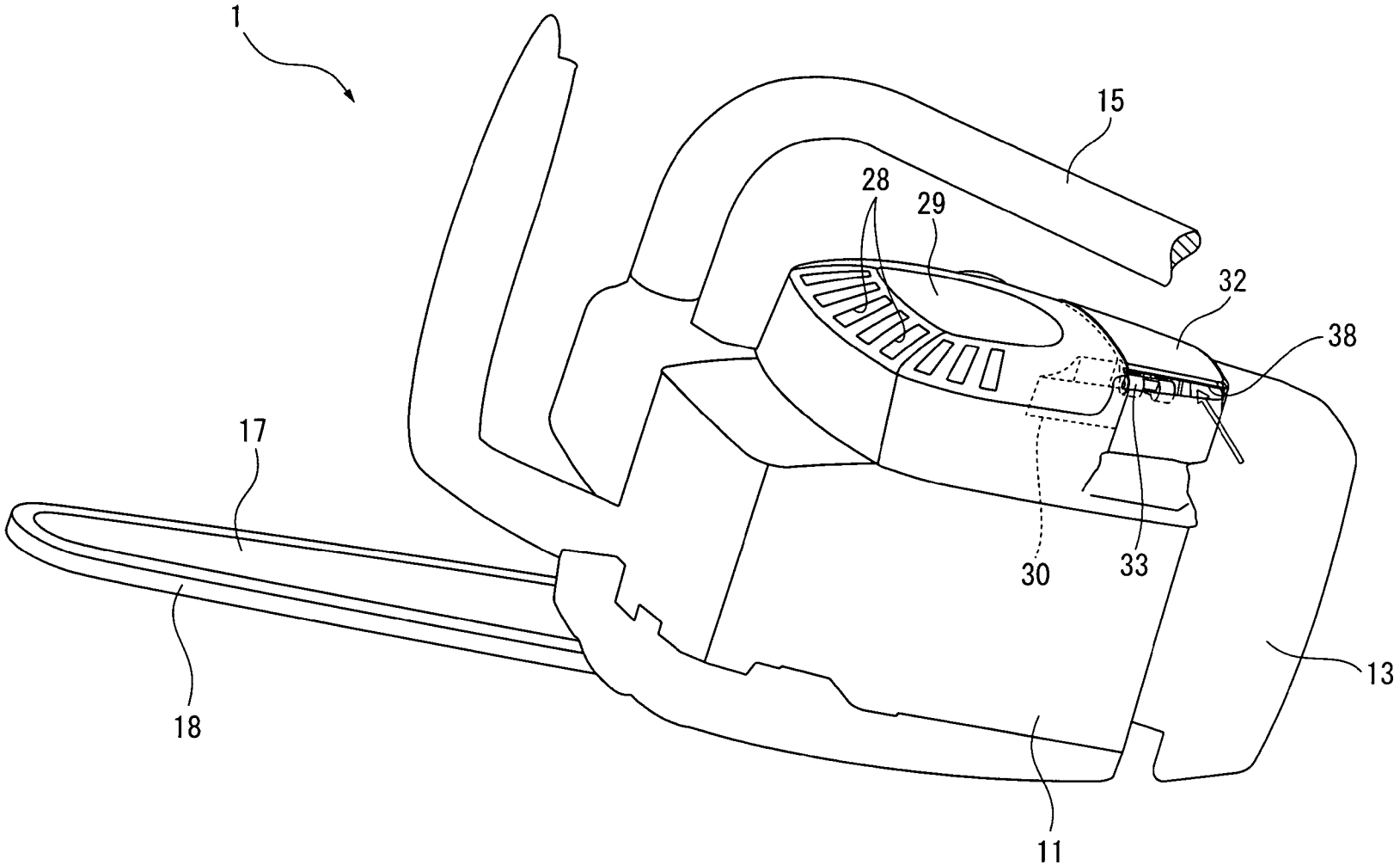
FIG. 3 is a perspective view illustrating the portable work machine as viewed from a bottom side.
Figure 4:
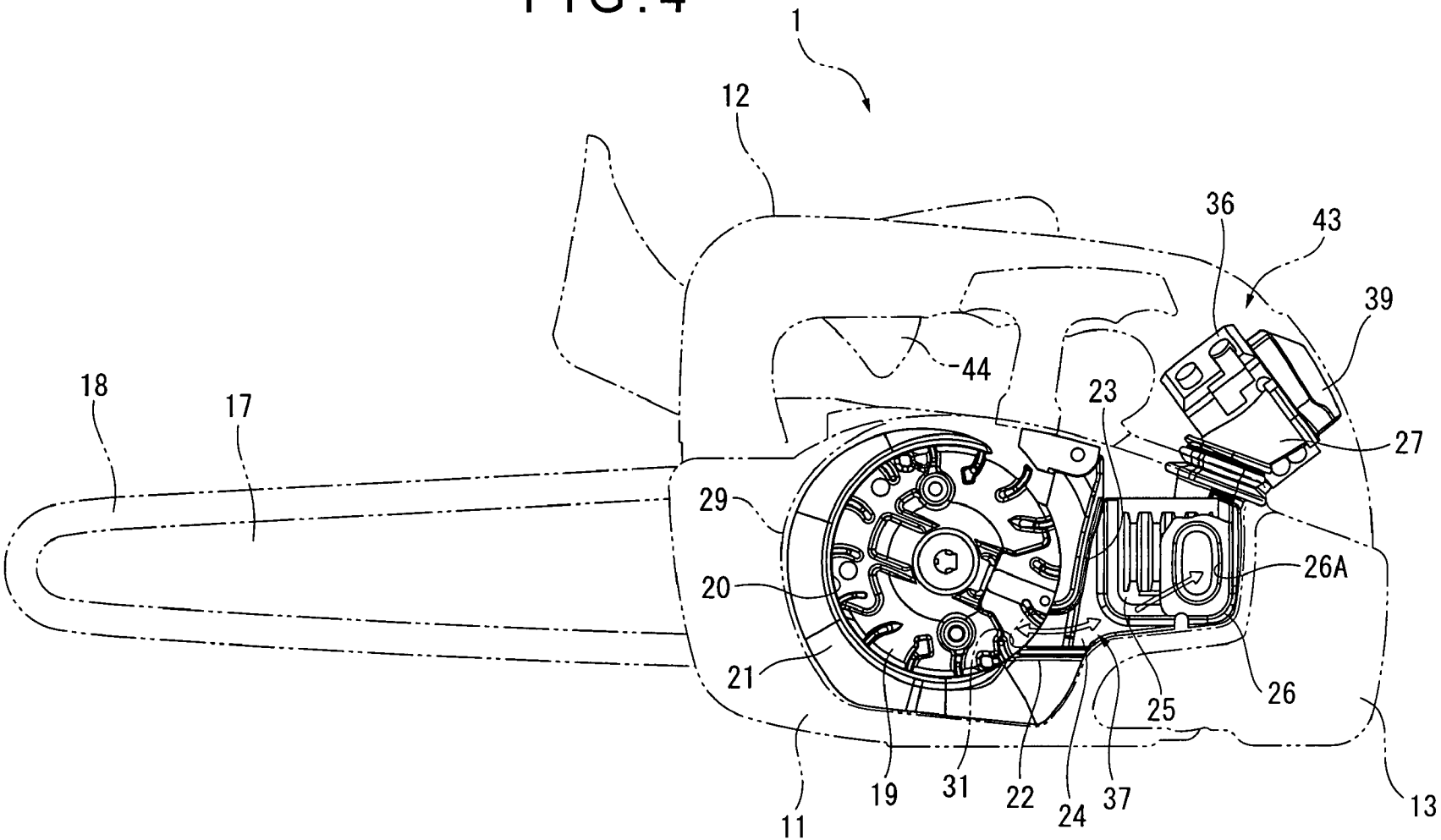
FIG. 4 is a side view illustrating a part of the primary portion of the portable work machine.
Figure 5:
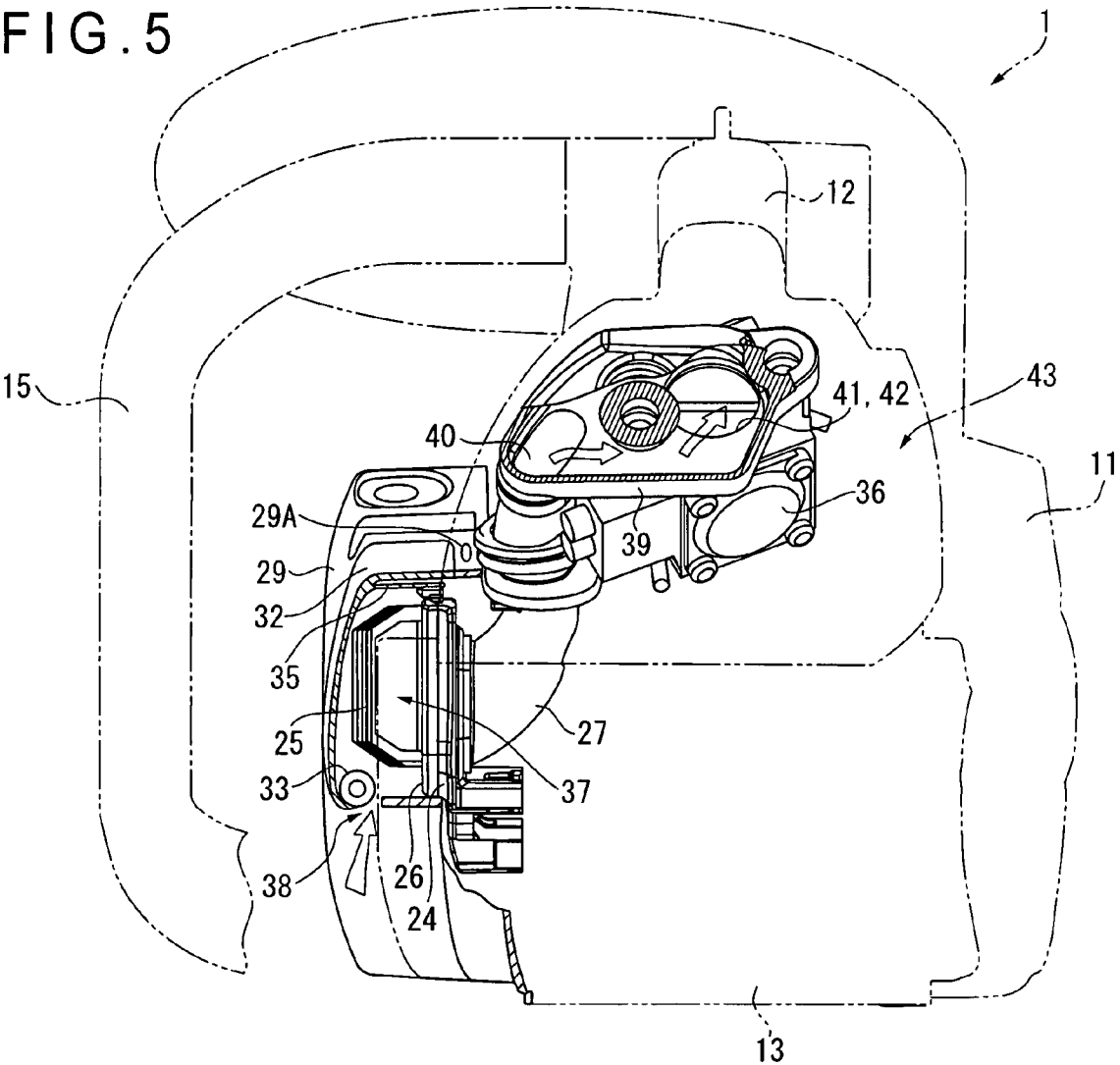
FIG. 5 illustrates the part of the primary portion of the portable machine as viewed from a rear side.

FIG. 1 is a perspective view schematically illustrating an entire chain saw (portable work machine) 1 according to the exemplary embodiment. FIG. 2 is a perspective view illustrating a primary portion of the chain saw 1. FIG. 3 is a perspective view illustrating the chain saw 1 as viewed from a bottom side. FIG. 4 is a side view illustrating a part of the primary portion of the chainsaw 1 and FIG. 5 illustrates the part of the primary portion as viewed from a rear side.

The chain saw 1 includes a top handle 12 above a body 11, and a handle 14 having one end connected to a front portion of the top handle 12 and the other end connected to a part of a fuel tank 13 in a rear bottom portion of the body 11. The fuel tank 13 according to the exemplary embodiment is integrated with the top handle 12.

As shown in FIG. 2, the body 11 includes a small two-cycle engine 15 having a crankcase (not shown) therein. Though not illustrated, a sprocket is pivotally supported on one end of a crankshaft 16 protruding from the engine 15 through a centrifugal clutch. A saw chain 18 is wound around the sprocket and a guide bar 17 provided beside the body 11 to be driven by the engine 15.

A cooling fan 19 circumferentially having a plurality of fins is attached to the other end of the crankshaft 16. A fan case 21 having an intake opening 20 is provided surrounding the cooling fan 19. A volute that surrounds an outer circumference of the cooling fan 19 is provided on a rear surface of the fan case 21. The volute works as an air passage for feeding an intake cooling air into the engine 15.

A communication passage forming section 24 having two partitions 22 and 23 is integrally provided on a surface of the fan case 21. An attachment 26 for attaching a cartridge type air cleaner 25 is provided in a vertical-sheet-shaped portion at a rear portion of the communication passage forming section 24. The attachment 26 is provided by a U-shaped consecutive protrusion, the protrusion defining an engaging groove against the sheet-shaped portion. The air cleaner 25 is slid from the above into the engaging groove of the attachment 26.

As described above, the air cleaner 25 is disposed at a lateral side of the body 11 according to the exemplary embodiment. Conventionally, the lateral side portion of the body 11 has been used as a space for an intake communication passage that intercommunicates between proximity of a cooling fan and a carburetor chamber. However, since the space for the intake communication passage is also used as a space for the air cleaner 25 according to the exemplary embodiment, the air cleaner 25 can be disposed without greatly increasing the size of the body 11 in which the air cleaner 25 is accommodated. Also, the size of the top handle 12 can be reduced since it is not necessary that the air cleaner 25 is disposed in the top handle 12 in which a carburetor 36 is accommodated.

As shown in FIG. 4, an opening 26A is provided in a sheet-shaped portion surrounded by the attachment 26. One end of a hollow first communication member 27 is fitted into the opening 26A by a grommet. FIG. 4 is a partial cutaway view of the air cleaner 25 of the above-described arrangement.

On the other hand, the fan case 21 is covered with a cover 29 having a plurality of vents 28. A recoil starter (not shown) that is connected to and disconnected from the cooling fan 19 through a ratchet mechanism and a partition wall 30 protruding toward the fan case 21 are provided on a rear surface of the cover 29.

A part of the partition wall 30 is abutted on the partitions 22 and 23 adjacent to the fan case 21. Other parts of the partition wall 30 protrude into the intake opening 20 of the fan case 21. An opening provided by the protruding parts and an inner circumference of the intake opening 20 is a suction opening 31 positioned opposite to a disk-shaped portion of the cooling fan 19 (FIG. 4). A bottom circumference and a rear vertical circumference of the vertical-sheet-shaped portion of the fan case 21 along the U-shaped attachment 26 are covered with the cover 29.

The cover 29 has an opening portion opposite to the air cleaner 25. An open-close lid 32 is attached to the opening portion. A hinge 33 is provided below the open-close lid 32 and rotatably and pivotally supported by the cover 29, by which the open-close lid 32 is opened and closed in a pivotal manner. An engaging claw 34 is provided on an upper side of the open-close lid 32, and engageable with an engaging hole 29A provided on an upper surface of the cover 29.

The open-close lid 32 is opened and closed to attach and detach the air cleaner 25. More specifically, the open-close lid 32 is opened by disengaging the engaging claw 34 from the engaging hole 29A to provide an upper-side opening portion. Through this upper-side opening portion, the air cleaner 25 is pulled upwardly from the attachment 26 or is downwardly inserted into the attachment 26.

As shown in FIG. 5, a partition piece 35 protruding toward the fan case 21 is provided on a rear surface of the open-close lid 32. When the open-close lid 32 is closed, a distal end of the partition piece 35 is abutted on an upper end of the air cleaner 25. Accordingly, a space around the communication passage forming section 24 of the fan case 21 is covered with the cover 29 and the open-close lid 32 to be semi-hermetically sealed. This semi-hermetically sealed space provides an upper stream portion of an intake communication passage 37 (i.e., an upper stream relative to the air cleaner 25) that intercommunicates between the proximity of the cooling fan 19 and the carburetor 36 in the top handle 12.

As shown in FIG. 3, a gap 38 that communicates with the outside is purposely provided between the open-close lid 32 and the cover 29 adjacent to the hinge 33 of the open-close lid 32. A function of the gap 38 will be described later. Since the gap 38 is provided on a lower side of the open-close lid 32, seepage of rain water and the like is prevented.

A first communication member 27 fitted to the opening 26A of the fan case 21 extends to a carburetor chamber 43 in the top handle 12 provided on an upper side. As shown in FIGS. 4 and 5, an upper end of the first communication member 27 is fitted to a second communication member 39 formed in a hollow flat square box shape. Specifically, the second communication member 39 includes an intake port 40 and an outlet port 41. The intake port 40 is connected to the upper end of the first communication member 27.

The second communication member 39 is screwable into the carburetor 36. When the second communication member 39 is screwed to the carburetor 36, the outlet port 41 of the second communication member 39 is attached tightly to an intake passage 42 of the carburetor 36. An inner space that intercommunicates between the first and second communication members 27 and 39 is a closed space where air is not sucked except from the opening 26A.

The first and second communication members 27 and 39 define a lower stream of the intake communication passage 37 (i.e., a lower stream relative to the air cleaner 25). According to the exemplary embodiment, the air cleaner 25 is disposed in the outside of the carburetor chamber 43 that includes the carburetor 36 and adjacent to a suction opening 31 in the intake communication passage 37.

An intake air including dust that is sucked from the plurality of vents 28 by the cooling fan 19 is drawn in an axial direction of the cooling fan 19 through the intake opening 20 of the fan case 21, and then radially and outwardly fed into the engine 15 through an air-blow passage on an outer circumference of the engine 15 to cool the cylinder and the like.

A part of the cooled air is fed into the engine 15 as air-fuel mixture through the suction opening 31, the intake communication passage 37, and the carburetor 36 by attraction of the engine 15. The dust in the cooled air sucked by the cooling fan 19 is fed into the air-blow passage through the suction opening 31 by centrifugal force after a stream direction of the cooled air is changed from an axial direction to a radial direction. Then, the dust is exhausted to the outside of the body 11 with the cooled air that cools the engine 15.

Therefore, the dust sucked from the suction opening 31 can be reduced. Also, frequent maintenance is not required because an amount of the dust caught by the air cleaner 25 is reduced. In the intake communication passage 37, the lower stream space as viewed from the air cleaner 25 defines the closed space and directly communicates with the intake passage 42 of the carburetor 36. Therefore, the attraction of the engine 15 is not generated in the carburetor chamber 43 formed in the top handle 12 and dust in the air sucked from a little gap in the carburetor chamber 43 is reduced, which efficiently prevents the carburetor 36 from being soiled by the dust.

When the throttle 44 is returned to an original position and a speed of the engine 15 is slowed down to an idling speed, a throttle valve of the carburetor 36 is closed. Accordingly, negative pressure on the cooling fan 19 for maintaining rotating force by inertial force becomes larger than the attraction of the engine 15 in the intake communication passage 37. Thus, a lot of air is sucked from the above-described gap 38 disposed below the air cleaner 25, and the dust caught by the air cleaner 25 is removed and returned toward the cooling fan 19 to be exhausted to the outside with the cooled air.

The best arrangements, methods, and the like for carrying out the invention have been heretofore disclosed, but the scope of the invention is not limited thereto. Although the invention is illustrated and described mainly with reference to a specified embodiment, those skilled in the art may variously modify the embodiment in shapes, amounts, and other specific arrangements without departing from the spirit and an object of the invention.

The above disclosure limiting the shapes, amounts, and the like are merely exemplary statements for facilitation of the understanding of the invention and do not limit the scope of the invention. Statements of members without part of or all of the limitations on the shapes, amounts, and the like are within the scope of the invention.

For example, although the air cleaner 25 is disposed at the lateral side of the body 11 and adjacent to the cooling fan 19, the air cleaner 25 may be disposed adjacent to the guide bar 17. However, the air can be sucked by a centrifugal separation function of the cooling fan 19 and the dust can be removed by the negative pressure because the air cleaner 25 is disposed adjacent to the cooling fan 19. Therefore, it is preferably that the invention is carried out according to the exemplary embodiment.

The invention claimed is:

1. A chain saw comprising:

a body in which an engine is accommodated;

a top handle provided above the body;

a carburetor accommodated in the top handle, the carburetor generating air-fuel mixture to be supplied to the engine;

an air cleaner provided on a lateral side of the body, the air cleaner having a cartridge to catch dust; and an intake communication passage which intercommunicates between the air cleaner and an intake passage of the carburetor;

wherein an end of a crankshaft of the engine is located at the lateral side of the body at which the air cleaner is provided.

2. The chain saw according to claim 1, wherein a cover is provided on the lateral side of the body, an open-close lid is provided in an opening portion of the cover, and the air cleaner is covered with the open-close lid.

3. The chain saw according to claim 2, wherein the open-close lid is rotatably and pivotally supported by the cover through a hinge provided on a lower side of the open-close lid, and the air cleaner is vertically inserted into and removed from the body through an upper opening portion formed by opening the open-close lid.

* * * * *